United States Patent [19]

Lloyd et al.

[11] Patent Number: 4,514,607

[45] Date of Patent: Apr. 30, 1985

[54] ELECTRICAL CIRCUIT INTERRUPTING DEVICES

[75] Inventors: Harold Lloyd, Dorset; David S. L. Slinn, Bristol, both of England

[73] Assignee: The Electricity Council, London, England

[21] Appl. No.: 366,909

[22] Filed: Apr. 9, 1982

[30] Foreign Application Priority Data

Apr. 13, 1981 [GB] United Kingdom ..... 8111683

[51] Int. Cl.[3] ..... H01N 33/75; H01N 33/22

[52] U.S. Cl. ..... 200/150 A; 200/150 R

[58] Field of Search ..... 200/150 A, 148 G, 150 R

[56] References Cited

FOREIGN PATENT DOCUMENTS

| | | | |
|---|---|---|---|
| 1121162 | 1/1962 | Fed. Rep. of Germany | 200/150 A |
| 191653 | 10/1937 | Switzerland | 200/150 A |
| 293428 | 6/1929 | United Kingdom | 200/150 A |
| 301493 | 2/1930 | United Kingdom | 200/150 A |
| 393927 | 12/1933 | United Kingdom | 200/150 A |
| 519821 | 4/1940 | United Kingdom | 200/150 A |
| 589318 | 6/1947 | United Kingdom | 200/150 A |
| 609589 | 10/1948 | United Kingdom | 200/150 A |
| 740787 | 11/1955 | United Kingdom | 200/150 A |
| 791760 | 3/1958 | United Kingdom | 200/150 A |
| 2083707 | 3/1982 | United Kingdom | 200/150 A |
| 2086656 | 5/1982 | United Kingdom | 200/150 A |

*Primary Examiner*—Robert S. Macon

*Attorney, Agent, or Firm*—Beveridge, DeGrandi & Kline

[57] ABSTRACT

An electrical circuit interrupting device such as a circuit breaker or switch has openable contacts immersed in a first relatively dense liquid, such as a perfluorocarbon, constituting an arc interruption medium and has a second less dense non-flammable dielectric liquid e.g. a halogenated liquid such as perchloroethylene or trichlorobenzene or carbontetrachloride constituting a coolant forming a second phase above the first liquid.

14 Claims, 4 Drawing Figures

ELECTRICAL CIRCUIT INTERRUPTING DEVICES

BACKGROUND OF THE INVENTION

1. Field of the Invention

This invention relates to electrical circuit interrupting devices incorporating an arc extinguishing liquid.

2. Prior Art

It is well known in circuit breakers, switches, ring main units, switch disconnectors and other switch gear for switching electrical circuits to have relatively movable switching contacts immersed in an arc extinguishing fluid. Although mineral hydrocarbon oils are widely used for this purpose, they possess a number of disadvantages and in particular they are flammable and form flammable or explosive gases when subjected to an electric arc. It has been proposed to use various non-flammable fluids, particularly halogenated hydrocarbons, as substitutes for such mineral oil. Problems arise however with such materials, in particular the production of toxic materials when an arc occurs in the fluid.

BRIEF SUMMARY OF THE INVENTION

According to one aspect of this invention an electrical circuit interrupting device comprises a housing having relatively movable contacts and a contact operating mechanism or mechanisms, which housing contains a first relatively dense liquid constituting an arc interruption medium in which the contacts are immersed and a second less dense non-flammable dielectric and coolant liquid which forms a separate phase with respect to the first liquid. Because it is less dense, the second liquid lies above the level of the first liquid.

The term "liquid" is used throughout this specification to refer to a material which is liquid at the ambient temperatures in which the device is to be operated. The arc produced on opening contacts will, in general, vapourised some of the first liquid. One of the advantages of this construction is that the second liquid provides a good cooling medium for condensing such vapour.

By this construction, it is possible to use a relatively small amount of the first liquid. This considerably widens the economically possible choice of arc interruption medium. The volume of the second liquid can be very much larger than that of the first liquid and this second liquid constitutes a coolant in which any vapour of the first liquid produced by an arc can condense.

The use of two liquid phases avoids the need for a construction employing a pressure vessel or vessels, as is required with pressurized gas dielectrics.

The first liquid may be in the bottom of the housing. It is preferred however to provide, within the housing, a chamber or chambers, open its upper end or their upper ends, to the interior of the housing, to contain the contacts and arranged so that condensed vapour of said first liquid runs back into the chamber or chambers. The volume of such a chamber or chambers can be quite small compared with that of the housing.

It is known that compounds comprising carbon and fluorine only have inert characteristics making them suitable as an arc interruption medium. These inert characteristics are largely retained in compounds comprising mainly carbon and fluorine together with a minor number of alternative atoms in the molecule such as oxygen, nitrogen or chlorine. Such inert compounds containing carbon and fluorine only or predominantly of carbon and fluorine will be referred to hereinafter as perfluorocarbon compounds. Such compounds are expensive and it has heretofore not been economically possible to make use of these compounds in large electrical circuit interrupting devices.

The present invention provides, inter alia, an improved construction of electrical circuit interrupting device permitting of the economical use of perfluorocarbon compounds.

According to another aspect of the present invention, an electrical circuit interrupting device comprises a housing containing relatively movable interruption contacts in a chamber or chambers positioned below a contact operating mechanism or mechanisms, the chamber or chambers containing the interruption contact being filled with a liquid perfluorocarbon compound to constitute an arc interruption medium, this compound extending to a sufficient height in said chamber or chambers to ensure that any arc is developed in the perfluorocarbon compound, the housing containing a dielectric and coolant medium comprising a second liquid of lower density than the perfluorocarbon compound, which forms a separate phase above the level of the perfluorocarbon filling the chamber or chambers. The second liquid is conveniently a halogenated fluid filling the housing above the level of the perfluorocarbon. Typically it may extend around the switch operating mechanism.

The perfluorocarbon is preferably a fully fluorinated liquid hydrocarbon, containing from 3 to 8 carbon atoms in the molecule. Such perfluorocarbons are liquid at the normal operating temperature and therefore will remain in said chamber or chambers below the level of the halocarbon forming the lower density dielectric and coolant medium. Such perfluorocarbons are very expensive but, by using the arrangement described above in which the perfluorocarbon surrounds only the movable contacts, the perfluorocarbon may be contained within a chamber or chambers relatively small compared with the much larger volume of dielectric and coolant medium in the housing. The perfluorocarbons are non-flammable and give rise to low yields of toxic products and negligible solid particle formation under electrical arcing.

It is necessary that the perfluorocarbon and the second liquid, e.g. a halogenated liquid, should form two separate phases. The two liquid phases should be substantially immiscible, preferably with a solubility of one phase in the other being less than 10% and more preferably less than 6% by weight.

Examples of halogenated liquids suitable for use as said second liquid are perchloroethylene, trichlorobenzene, carbon tetrachloride and other chlorinated paraffins or halogenated aromatic or blends of these.

The perfluorocarbon forms an arc extinguishing medium and is a dielectric medium. The second phase, e.g. the other halogenated liquid which forms the upper phase, should be present in much larger volume than the perfluorocarbon, typically 5–100 times greater by volume. A liquid halogenated fluid forming the upper phase constitutes a significant thermal sink in which perfluorocarbon vapour, evaporated by arcing energy, can condense.

Conveniently the perfluorocarbon and the second liquid, e.g. halogenated fluid, are contained in the housing at substantially atmospheric pressure. If the pressure is atmospheric, the housing may be vented. With a sealed housing, the fluids may be typically at a pressure in the range from say ½ an atmosphere to 12 atmospheres absolute.

DESCRIPTION OF THE PREFERRED EMBODIMENTS

Figure 1:
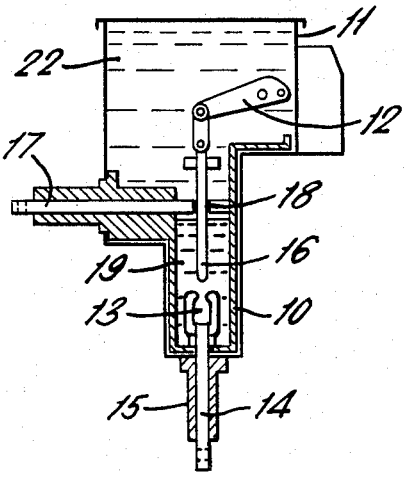
FIG. 1 is a diagrammatic section through one construction of switch gear constituting one embodiment of the invention.

Referring to FIG. 1 there is shown diagrammatically in vertical section part of a switch having "poker and rose" type contacts in a chamber 10 forming the lower part of a housing having a main upper part 11 containing a switch operating mechanism 12. In this particular switch, there is a fixed lower contact 13 mounted in the bottom of the chamber 11 and electrically connected by a conductor 14 passing through a seal 15 in the bottom of the chamber 10. The upper movable contact 16 can move in a vertical direction between a lower closed position in which it makes electrical connection with the lower contact 13 and an upper position in which it is raised away from the contact 13 to interrupt the circuit. The contact 16 electrically is connected to an external connector 17 by means of a sliding contact 18.

The chamber 10 is filled with a perfluorocarbon liquid 19 compound as hereinbefore defined. This perfluorocarbon compound is typically a fully fluorinated fluorocarbon containing from 3 to 8 carbon atoms in the molecule but, as previously indicated, it may contain a minor number of alternative atoms such as oxygen, nitrogen or chlorine which can ensure the inert characteristics associated with substances containing carbon and fluorine only. The perfluorocarbon fills the chamber 10 at least up to a level such that the upper contact member still extends into the perfluorocarbon when raised to its uppermost limit.

The upper part 11 of the housing is a substantially larger vessel than the lower part 10 in order to house the operating mechanism 12 and also to ensure a sufficient mass of dielectric material to provide the necessary cooling. This housing is filled with a halogenated liquid 22. Preferably a liquid halocarbon is employed such as perchloroethylene. The halogenated upper phase is less dense than the perfluorocarbon and is substantially immiscible therewith so as to ensure that the two materials separate with the halogenated liquid floating on top of the perfluorocarbon.

On interruption of the electrical circuit by movement of the movable contact upwardly, an arc is drawn which results in vaporisation of some of the perfluorocarbon. This volatilised perfluorocarbon constitutes an arc extinguishing medium but is condensed within the halogenated upper phase dielectric and/or on the walls of the containing vessel. The condensed perfluorocarbon falls back into the chamber 10. On closing of the contact when switching electrical circuits, arcing may take place although usually to a significantly lesser extent. This is generally known as pre-arcing. If it occurs, the perfluorocarbon volatilises and condenses as described above.

Figure 2:
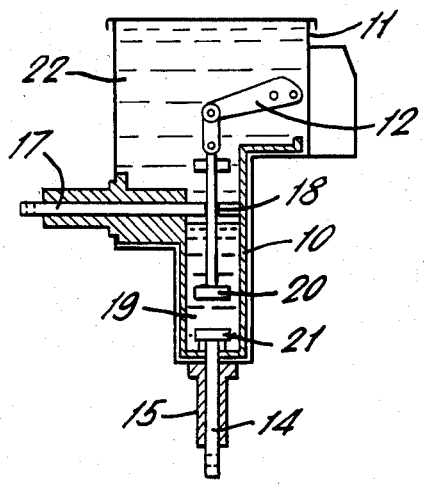
FIG. 2 illustrates a modification of the switch gear of FIG. 1.

FIG. 2 illustrates a modification of the switch of FIG. 1 in which butt contacts 20, 21 are provided for the relatively movable contacts. The switch of FIG. 2, apart from the form of contacts, is similar to that of FIG. 1 and similar reference numerals are used to indicate corresponding components. The operation is similar to that of FIG. 1.

Figure 3:
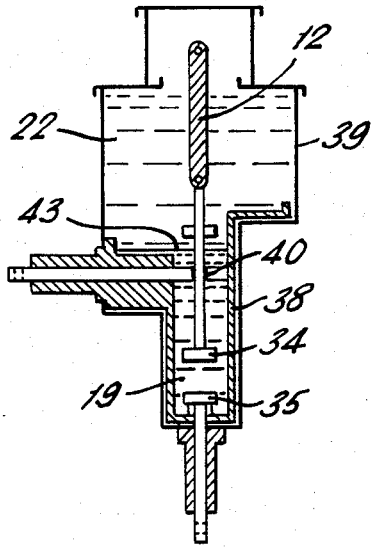
FIG. 3 is a diagrammatic section through another construction of switch gear.
Figure 4:
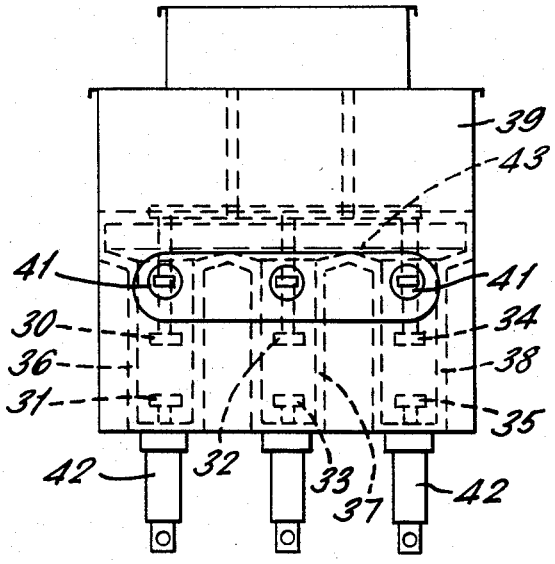
FIG. 4 is a front elevation diagram of the switch gear of FIG. 3.

FIGS. 3 and 4 illustrate a typical arrangement for three-phase switch gear. In this particular example there are three pairs of butt contacts 30, 31; 32, 33; and 34, 35; for switching respectively the three phases. These contacts are contained in separate chambers 36, 37 and 38 located in the bottom of the switch gear housing 39. These chamber are of sufficient size to contain the respective contacts keeping the contacting portion immersed in perfluorocarbon 19 even when the movable upper contact is raised to its upper limit. The main body of the switch gear housing 39 is filled as before with a halocarbon 22. A single operating mechanism is employed and hence all three chambers 36–38 open into a common region containing the halocarbon. Each of the movable contacts 30, 32, 34 slides in a respective sliding contact 40 (FIG. 3) with its associated output connectors 41. The fixed contacts 31, 33, 35 are electrically connected to respective connectors 42. The amount of perfluorocarbon must be such that the perfluorocarbon fills the lower part of the switch gear to a level indicated at 43 just above the boundaries between the separate chambers 36–38 so that, when the perfluorocarbon condenses, it will fill all three chambers 36–38.

Many forms of contact arrangement may be employed and the above-described embodiments are merely examples only of possible constructions.

We claim:

1. An electrical circuit interrupting device comprising a housing having relatively movable contacts and at least one contact operating mechanism, which housing contains two immiscible fluids in contact with one another, which fluids are both liquid at ambient temperature, one being relatively dense first liquid constituting an arc interruption medium in which the contacts are immersed and the other less dense non-flammable dielectric and coolant second liquid which forms a separate phase with respect to the first liquid, the volume of the second liquid being greater than that of the first liquid, the second liquid forming a cooling medium for condensing vapour produced by the arc.

2. An electrical circuit interrupting device as claimed in claim 1 wherein the volume of the second liquid is 5 to 50 times larger than that of the first liquid.

3. An electrical circuit interrupting device as claimed in claim 1 wherein the first liquid is in the bottom of the housing.

4. An electrical circuit interrupting device as claimed in claim 1 wherein a chamber is provided within the housing to contain at least one pair of co-operating contacts, the chamber being open at its upper end to the interior of the housing, the housing being arranged so that any vapour of said first liquid, condensed in the second liquid, will run back into said chamber.

5. An electrical circuit interrupting device as claimed in claim 1 wherein the first liquid is a perfluorocarbon which is liquid at the normal operating temperature.

6. An electrical circuit interrupting device as claimed in claim 1 wherein the second liquid is a halogenated fluid.

7. An electrical circuit interrupting device as claimed in claim 1 wherein the second liquid is perchloroethylene or trichlorobenzene or carbon tetrachloride or a liquid chlorinated paraffin or a blend of these materials.

8. An electrical circuit interrupting device comprises a housing containing relatively movable interruption contacts in at least one chamber positioned below a contact operating mechanism, the chamber containing the interruption contact being filled with a perfluorocarbon compound to constitute an arc interruption medium, this compound extending to a sufficient height in said chamber to ensure that any arc is developed in the perfluorocarbon compound, the housing containing a dielectric and coolant medium comprising a second liquid of lower desity than the perfluorocarbon compound, which is in contact with the first liquid and forms a separate phase above the level of the perfluorocarbon, the volume of the second liquid being greater than that of the first liquid so that the second liquid forms a coolant for condensing any vapour produced by the arc.

9. An electrical circuit operating device as claimed in claim 8 wherein the perfluorocarbon is a fully fluorinated liquid hydrocarbon containing from 3 to 8 carbon atoms in the molecule.

10. An electrical circuit operating device as claimed in claim 8 wherein the perfluorocarbon surrounding the movable contacts is contained within a chamber or chambers relatively small compared with the much larger volume of dielectric and coolant medium in the housing.

11. An electrical circuit interrupting device as claimed in claim 8 wherein the second liquid is a liquid halogenated fluid.

12. An electrical circuit interrupting device as claimed in claim 8 wherein the second liquid is perchloroethylene or trichlorobenzene or carbon-tetrachloride or other chlorinated paraffins or halogenated aromatic or blends of these.

13. An electrical circuit interrupting device as claimed in claim 8 wherein the second fluid is a halocarbon.

14. An electrical circuit interrupting device as claimed in claim 8 wherein the perfluorocarbon and second liquid are contained in the housing at substantially atmospheric pressure.

* * * * *